US006058526A

United States Patent [19]

Parisi et al.

[11] Patent Number: 6,058,526

[45] **Date of Patent: *May 9, 2000**

[54] DRAIN ASSEMBLY

[75] Inventors: Bernard Parisi, Barnegat; David J. Burke, Brick, both of N.J.

[73] Assignee: Component Hardware Group, Inc., Lakewood, N.J.

[ * ] Notice: Under 35 U.S.C. 154(b), the term of this patent shall be extended for 628 days.

[21] Appl. No.: 08/666,093

[22] Filed: Jun. 19, 1996

[51] Int. Cl.[7] ..... E03C 1/23

[52] U.S. Cl. ..... 4/688; 4/287; 4/288

[58] Field of Search ..... 4/287, 288, 290, 4/292, 541.6, 652, 653, 682, 683, 688, 286, 650, 679, 680, 681, 693

[56] References Cited

U.S. PATENT DOCUMENTS

| | | | |
|---|---|---|---|
| 0,413,365 | 10/1889 | Gilcher | 4/688 |
| 1,964,423 | 6/1934 | Blickman | 4/287 |
| 1,974,419 | 9/1934 | Cornell, Jr. | 4/688 |
| 2,580,575 | 1/1952 | Muckler | 4/683 |
| 2,597,399 | 5/1952 | Steele | 4/287 |
| 2,699,555 | 1/1955 | Green | 4/288 |
| 4,221,336 | 9/1980 | Diamond | 4/541.6 X |
| 4,379,097 | 4/1983 | Leggett | 4/541.6 X |
| 4,456,174 | 6/1984 | Neenan | 4/541.6 X |

*Primary Examiner*—Robert M. Fetsuga
*Attorney, Agent, or Firm*—McAulay Nissen Goldberg Kiel & Hand, LLP

[57] ABSTRACT

The drain assembly is constructed with a segmented ball valve of stainless steel or plastic which is rotatable between an open position and a closed position by a shaft extending from the drain body. An annular valve seat is biased against the valve body by a compression device and an annual retainer which is threaded into the valve body from above. A strainer may also be provided to catch large particles which might otherwise not be desirable for passage through the drain assembly. The valve body provides a relatively large opening for the discharge of fluids into a drain pipe.

23 Claims, 5 Drawing Sheets

DRAIN ASSEMBLY

This invention relates to a drain assembly. More particularly, this invention relates to a drain assembly for a sink.

As is known, commercial establishments, such as restaurants, and institutions typically have sinks of large capacity in order to be able to wash dishes, pots, pans, and like items or to rinse such items of left-over materials prior to washing these items in automatic dishwashers. Because of the large capacities of these sinks and the chemicals employed in the washing or rinsing operation, the use of a simple stopper or strainer to plug up the drain opening of such sinks in order to fill the sinks with water are generally not used. Instead, these sinks have had manually operated valves installed in the drain lines from the sinks in order to open and close the drain lines. Typically, the valves have been provided as part of a drain assembly. For example, these valves have been of a stopper type which employ a plunger having a head for sealing off a drain opening and a stem which depends through the opening into the drain line. In addition, these types of valves employ a lever system for moving the plunger up and down in order to open and close the drain assembly. Typically, these lever systems have a handle which can be manually operated by the user. In alternative constructions, the plungers may be actuated by a twisting motion. Other valves have also been known which employ closure bodies with a through opening, for example of rectangular shape so as to conduct a flow therethrough when in an open position. Various types of manual controls and handles have been provided for rotating the closure member between the open position and a closed position when desired.

In the past, the drain assemblies which have been provided for commercial sinks and the like have been of rather cumbersome structure so that installation requires the use of two persons or rather cumbersome techniques on the part of one person. That is to say, the drain assemblies have required fixation by some means from below while threaded members are threaded into the drain assemblies from above the sink in order to secure the drain assemblies in the sink.

It has also been known that commercial establishments use various types of sanitizers, cleaning solutions and/or photographic chemicals which are harsh and particularly corrosive to the components of drain assemblies. As a result, the seals used in these drain assemblies and even the other components of the drain assemblies have been eroded to the extent that the drain assemblies leak.

Where these drain assemblies have required maintenance or replacement of parts, dis-assembly of the drain assemblies from a sink has been time-consuming and cumbersome.

Still further, it has been know to provide commercial sinks with strainers which have been referred to as flat strainers. These strainers usually have holes to permit the passage of particles. However, one disadvantage of such flat strainers is the fact that the holes can become easily plugged by food parties such as peas and the like. It has also been known to use a crumb cup type strainer. Typically, such strainers have been provided with slots to permit the passage of fluid and small particles while trapping large particles from passing through the drain. However, one problem which arises with such strainers is that these strainers eventually become clogged with large particles so that drainage of the sink is retarded. Various modifications have been provided in such strainers to avoid a clogging situation, for example, by providing a strainer with a raised central portion of dome-shape with a plurality of vertical slots therein. In such cases, the vertically disposed slots in the dome-shaped central portion are intended to allow passage of fluid should the slots in the floor of the strainer become clogged by particles. However, even in such cases, the vertically oriented slots become clogged. Another disadvantage of such strainers is the fact that the dome-shape portions project upwardly from the bottom of the sink so that, over time, the dome-shape portions become damaged by impacts from utensils such as pots and pans which are dropped thereon. Continuous denting of the dome-shape portions eventually lead to a need to replace the strainers.

Accordingly, it is an object of the invention to provide a drain assembly which can be readily installed in a sink in a minimum of time by one person.

It is another object of the invention to provide a drain assembly which is relatively long lasting.

It is another object of the invention to increase the flow through of a drain assembly in an open condition.

It is another object of the invention to reduce the risk of clogging of a drain assembly with the use of an improved strainer.

It is another object of the invention to be able to service a drain assembly in a sink from above.

Briefly, the invention provides a drain assembly for a sink which is comprised of a body to define a fluid path, a hollow ball valve rotatably mounted in the body in the flow path to move between a closed position and an open position and means for rotating the ball valve between these positions.

In order to facilitate mounting in an opening of a sink the body is sized to pass through the opening from above and is provided with an annular flange to seat about the opening in the sink. The body also has a portion with an external thread which passes through the opening and which is located adjacent to the annular flange. A flange nut is also provided which threads onto this external thread of the body from below in order to secure the body in the sink.

When the valve body is placed in the sink, the installer need only drop the valve body through the opening in the sink and without further need to hold the valve body fixed, the installer may then gain access to the underside of the sink to pass the flange nut over the bottom of the valve body and into threaded relation on the external thread. Tightening of the flange nut can be accomplished from below the sink.

The hollow ball valve is of segmented shape and is provided with a tubular bore which passes completely through the body. When the ball valve is in the opened position this bore is disposed axially of the body and co-axial with the opening in the sink. When the valve body is turned into the closed position, the bore is disposed transversely of the body.

By using a ball valve, the bore of the ball valve can be sized to be of a diameter which is slightly smaller than the opening in a drain pipe leading from the sink. Thus, when the ball valve is moved into the opened position, a substantial quantity of flow may pass from the sink through the drain assembly into the drain pipe. As compared with previously known drain assemblies, such as the stopper type, the amount of fluid flow is substantially increased.

The means for rotating the ball valve between the open and closed positions may include an elongated shaft which is mounted in and which extends from the rotatable ball valve as well as a suitable handle or grip which is provided at the end of the shaft to facilitate turning of the shaft manually. Other types of devices may also be employed for effecting rotation of the ball valve between the open and closed positions.

The drain assembly also includes a retainer which is secured to and within the body in order to retain the ball valve within the body. In this regard, an annular valve seat is also provided between the ball valve and the retainer for sealingly seating against the ball valve and to provide a suitable seat to accommodate rotation of the ball valve between the open and closed positions. The seat may also be sealed relative to the valve body by means of an O-ring, such as a rubber ring coated with Teflon so as to be corrosion resistant. A compression device, such as an O-ring or an annular spring, is also provided coaxially between the valve seat and the retainer for biasing the valve seat against the ball valve.

The retainer may also be provided with a cross bar of standard type and a plurality of slot-defining projections or the like for the mounting of a strainer in place.

The drain assembly also includes a strainer which is disposed on the retainer and which carries a plurality of outwardly extending tabs for slidable reception within the slot-defining projections of the retainer. In this way, the strainer can be dropped into place and then turned slightly so as to lock the strainer to the retainer.

The strainer is in the form of an annular cup-shaped body having an upstanding outer peripheral wall, a planar floor and an upraised central portion having an inner peripheral wall and a planar top surface. In addition, the strainer is provided with a plurality of slots in the outer peripheral wall for draining of water therethrough as well as a plurality of arcuate slots in the floor for draining of water. Still further, a plurality of slots are provided in the inner peripheral wall and a plurality of openings are provided in the top surface of this central portion for drainage purposes. A suitable bail is also secured to the upraised central portion of the strainer to facilitate manual handling of the strainer and, in particular, rotation of the strainer relative to the retainer.

The drain assembly may also provide for an overflow condition. To this end, the body is provided with an overflow spigot which communicates with the fluid path through the drain body and which can be capped when not in use. When in use, a suitable overflow line may extend from the spigot to an elevated position in the sink.

The drain assembly may be made totally of plastic parts. Alternatively, the major components of the drain assembly such as the body, ball valve, retainer, strainer and lock nut may be made of stainless steel or the like. In such cases, the valve seat would be made of Teflon or similar material.

These and other objects and advantages of the invention will become more apparent from the following detailed description wherein.

Figure 1:
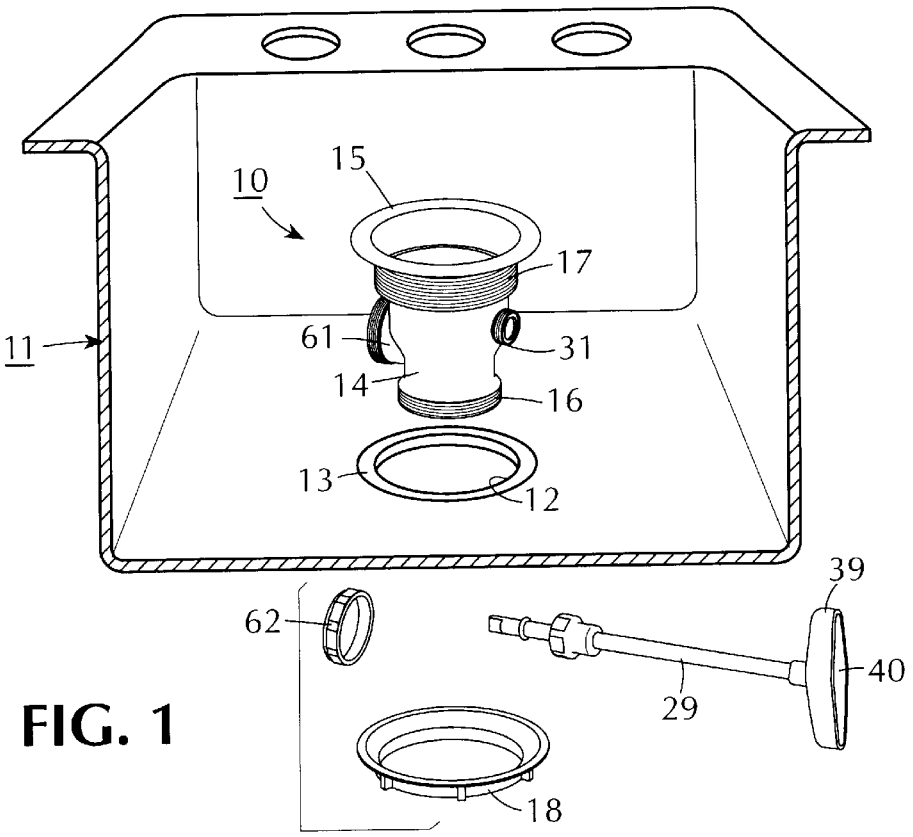
FIG. 1 illustrates an exploded view of a drain assembly to be mounted in a sink in accordance with the invention.

Referring to FIG. 1, the drain assembly 10 is adapted for mounting in a sink 11 of commercial construction. For example, the sink 11 has a relatively deep tub for receiving a large number of dishes, pots, pans and the like for rinsing and/or washing. As indicated, the sink is provided with a drain opening 12 in a bottom. This drain opening 12 is surrounded by a tapered surface 13 in the bottom of the sink as is conventional.

The drain assembly 10 includes a one piece body 14, for example, made of stainless steel, plastic or other suitable material. This one-piece body 14 is of hollow constructions to define a fluid path. The upper end of the body 14 has an annular flange 15 to seat about the opening 12 in the sink 11 and particularly to seat on the tapered portion 13 (see FIG. 4). In addition, the body 14 is provided with an external thread 16 at a lower end for purposes as described below as well as an external thread 17 at an upper end under the flange 15. As indicated in FIG. 4, the valve body 14 is sized to pass through the opening 12 in the sink 11 but for the annular flange 15.

The drain assembly 10 also includes a flange nut 18 which is sized to pass over the lower portions of the body 14 from below into threaded engagement with the external thread 17 in order to secure the body 14 to the sink 11 in a secure manner.

Figure 3:
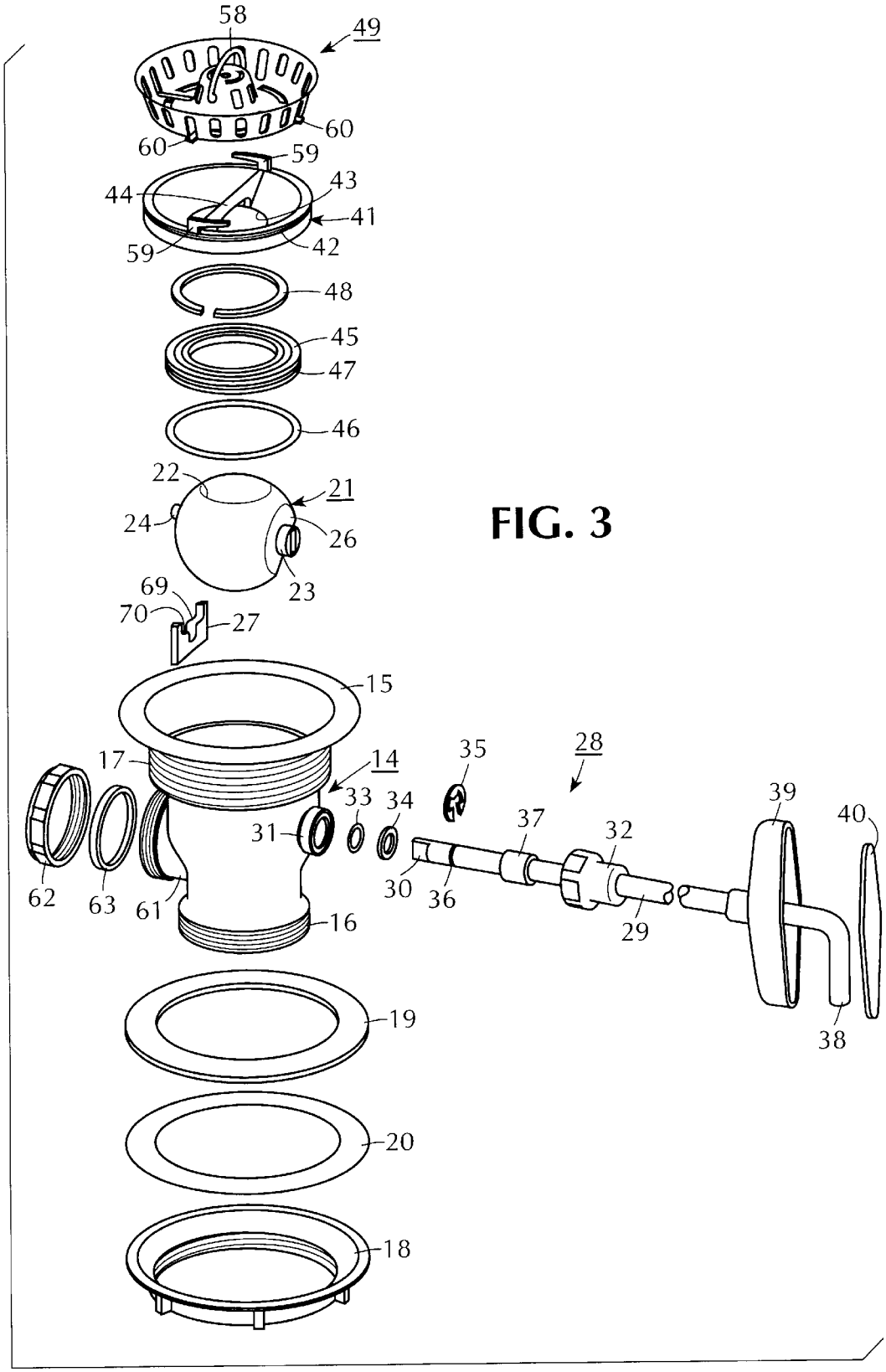
FIG. 3 illustrates an exploded view of the drain assembly of FIG. 2.
Figure 4:
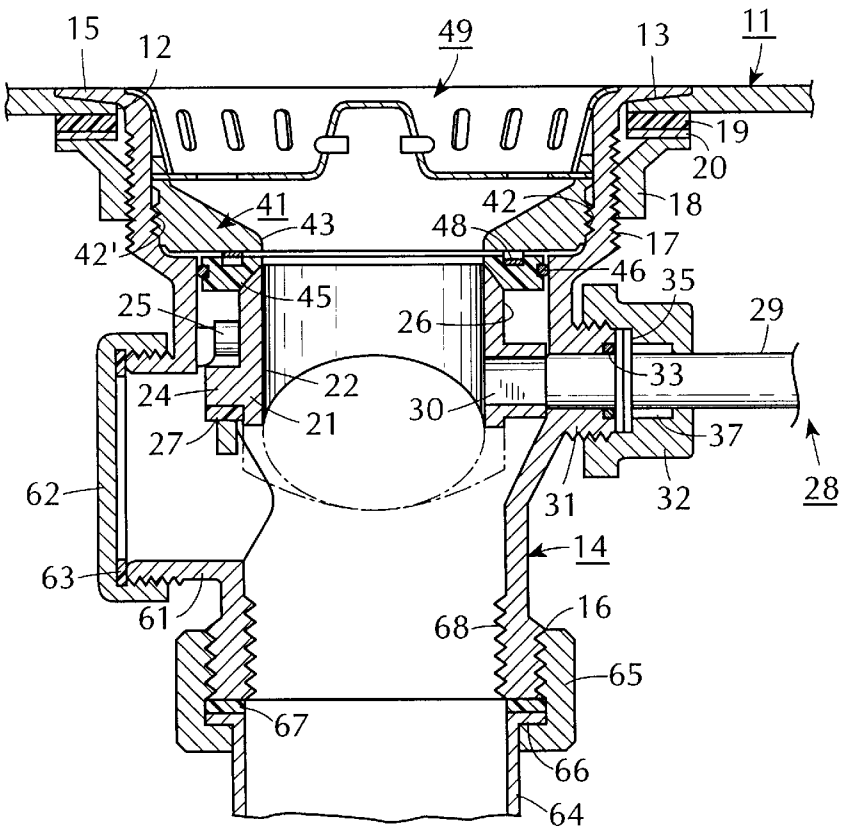
FIG. 4 illustrates a cross-sectional view of the drain assembly with the ball valve in an open position.

Referring to FIG. 3, in order to provide a seal tight connection between the flange nut 18 and the body of the sink 11, a compression means, such as a suitable flange gasket 19 and a slip ring 20 are provided between the flange nut 18 and the bottom of the sink 11 (see FIG. 4). As indicated, the flange gasket 19 may be made of a suitable plastic such as Teflon (a polytetrafluoroethylene) while the slip ring 20 is made of paper or other suitable material.

The drain assembly 10 also includes a hollow ball valve 21 of segmented shape which is rotatably mounted in the body 14 in the flow path through the valve body 14. To this end, the ball valve 21 is rotatable between a closed position (see FIGS. 5 and 7) closing the fluid path and an open position (see FIGS. 4 and 6) opening the fluid path.

Figure 5:
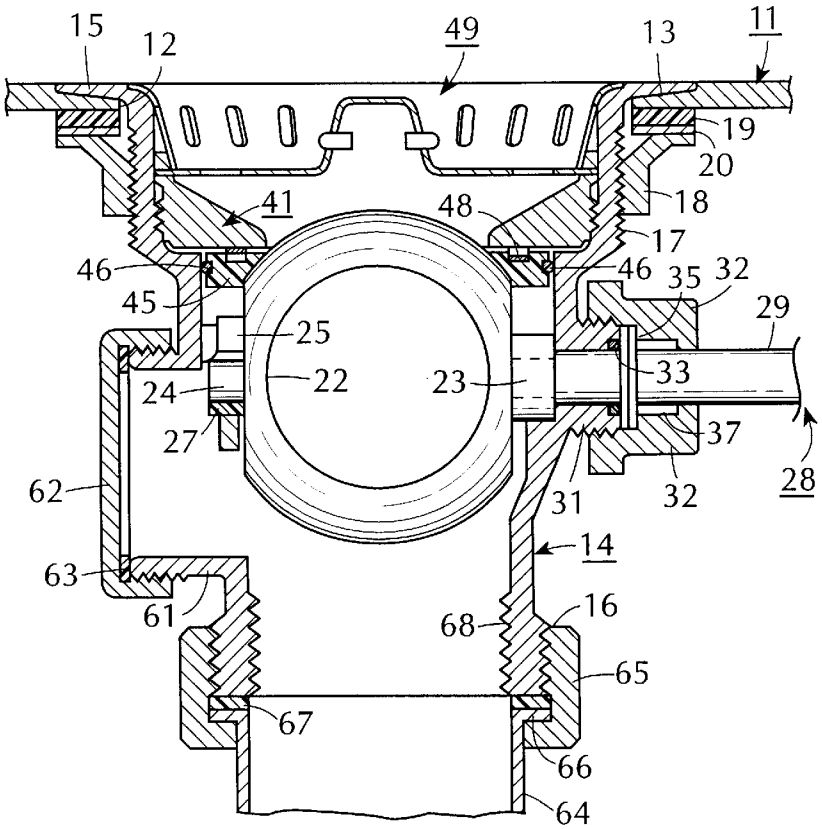
FIG. 5 illustrates a cross-sectional view of the drain assembly similar to FIG. 4 with the ball valve in a closed position.

The ball valve 21 has a tubular bore 22 disposed axially of the body 14 when in the open position (see FIG. 4) while being disposed transversely of the body 14 when in the closed position (see FIG. 5). In addition, the ball valve 21 has a socket 23 on one side, a roller 24 on a diametrically opposite side and a pin 25 adjacent the roller 24 (see FIG. 6). The socket 23 extends from a flattened portion 26 of the ball valve 21. The roller 24 is sized to be rotatably mounted in a trunion 27 which is separately mounted within the body 14 and the pin 25 acts as a stop to limit rotation of the ball valve 21 as explained below.

Referring to FIG. 4, the drain assembly is provided with a means 28 for rotating the ball valve 21 between the open and closed positions. As illustrated, this means 28 is constructed of an elongated shaft 29 which has a flattened end 30 which fits in mating relation within the socket 23 of the ball valve 21 and which extends through a spigot 31 in the body 14. This spigot 31 is provided with an external screw thread (see FIG. 4) so as to threadably receive a handle nut 32. An O-ring 33 is also provided within the spigot 31 for sealing purposes while a flat washer 34 is provided between the spigot 31 and a E-clip 35 is snapped into a groove 36 in the shaft 29. This clip 35 serves to prevent slippage of the shaft 29 out of the socket 23 of the ball valve 21 after the handle nut 32 has been threaded into place.

A bushing 37 is also provided on the shaft 29. During threading of the handle nut 32 onto the spigot 31, the bushing 37 slides into sealing relation with the retainer ring 35 and further defines a bearing surface between the handle nut 32 and the shaft 29.

As shown in FIG. 3, the shaft 29 terminates in a bent portion 38 which is received within a hollowed portion 39 of a two-piece grip. As indicated, the grip has a cover 40 to enclose the hollow portion 39 so as to contain the bent portion 38 of the handle. Alternatively, any other suitable type of grip may be provided over the bent portion of the shaft 29 or may be eliminated as the case may be.

Referring to FIGS. 4 and 5, the drain assembly also includes a retainer 41 of annular shape which is threadably secured to and within the body 14 in order to retain the ball valve 21 within the body 14. As shown in FIG. 4, the retainer 41 has an external thread 42 for threadably engaging within an internal thread 42' within the body 14. This retainer 41 also has an opening 43 coaxial of the body 14 which is smaller than the drain opening 12 in the sink 11. This opening 43 and the tubular bore 22 through the ball valve 21 are of approximately the same or similar diameter. Thus, the opening 43 and the bore 22 are capable of passing the same quantity of flow.

As shown in FIG. 3, the retainer 41 may also have a retainer bar 44 of conventional construction which passes diametrically above the opening 43.

The drain assembly 10 also includes an annular valve seat 45 which is disposed between the ball valve 21 and the retainer 41 for sealingly seating against the ball valve 21. An O-ring 46 is also disposed in an outer peripheral groove 47 of the valve seat 45 so as to be sealingly disposed between the valve seat 45 and an interior wall of the body 14 (see FIG. 4). A compression device, such as, an annular spring 48, e.g. a wave spring, is also disposed coaxially and directly between the valve seat 45 and the retainer 41 for biasing the valve seat 45 against the ball valve 21.

Figure 2:
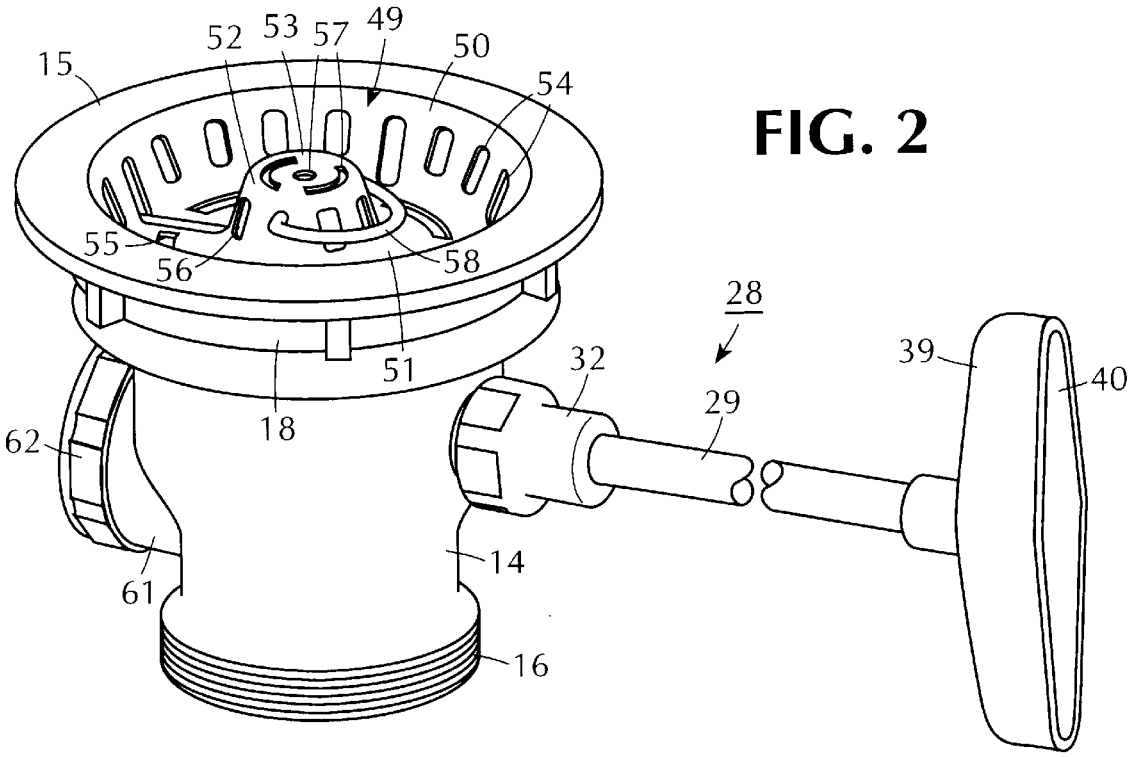
FIG. 2 illustrates a perspective view of a drain assembly according to the invention.

Referring to FIGS. 2 and 3, the drain assembly 10 also includes a strainer 49 which is disposed coaxially of and on the retainer 41. As illustrated, the strainer 49 is comprised of an annular cup-shaped body having an upstanding outer peripheral wall 50, a planar floor 51 and an upraised central portion having a peripheral wall 52 with a planar top surface 53. As shown, a plurality of slots 54 are provided in the outer peripheral wall 50 for draining the water therethrough. Likewise, a plurality of arcuate slots 55 are provided in the floor 51 for drainage purposes. Slots 56 are also provided in the inner peripheral wall 52 of the upraised central portion for drainage purposes and openings 57 are provided in the top surface 53. A bail 58 is also pivotally secured to the upraised central portion to allow manual manipulation of the strainer 49.

As shown in FIG. 3, the retainer 41 is provided with a pair of slot-defining projections 59 for slidably receiving tabs 60 which extend outwardly from the floor 51 of the strainer 49. Thus, in order to secure the strainer 49 to the retainer 41, the strainer 49 is manually dropped onto the retainer 41. Next, the strainer 49 is rotated via the bail 58 so that the tabs 60 on diametrically opposed sides of the strainer 49 slide under the projections 59 to lock the strainer 49 to the retainer 41. A reverse rotation permits unlocking of the strainer 49 from the retainer 41 when desired. As indicated in FIG. 3, each projection 59 may be provided with a tapered surface so as to increase the locking effect of the projection 59 on a received tab 60.

Referring to FIGS. 2 and 3, the valve body 14 may also be provided with a spigot 61 for purposes of overflow. In this respect, as indicated in FIG. 4, the spigot 61 communicates directly with the fluid path through the body 14. A cap 62 and a sealing ring 63 are also provided for closing off the spigot 41 when not in use. This cap 62 is sealingly mounted on the spigot 41. When in use, the cap 62 is removed and the spigot 61 is connected via a suitable line, flexible or otherwise, to an overflow opening in a side wall of the tub 11. Thus, should the level of water in the sink 11 rise to the overflow opening, the excess flow can run off through the overflow line into the spigot 61 and thence through a drain pipe 64 connected to the body 14.

As shown in FIGS. 4 and 5, the body 14 is connected to the drain pipe 64, also known as a tail piece, via a threaded nut 65 which threads onto the external thread 16 on the body 14 and an external flange 66 at the top of the drain pipe 64. A flat washer 67 is also disposed between the drain pipe 64 and body 14. As indicated, the drain body 14 is also provided with an internal thread 68 so as to accommodate threading onto a drain pipe directly.

As can be seen in FIG. 4, the opening 43 of the retainer 41, the bore 22 through the ball valve 21 and the internal diameter of the drain pipe 64 are of the same or substantially the same size. Thus, when the ball valve 21 is turned into the open position, any water in the sink 11 can be drained rapidly into and through the drain pipe 64. In this respect, the bore 22 of the ball valve 21 presents a relatively large opening from the sink 11 directly into the drain pipe 64 without throttling the flow.

Figure 7:
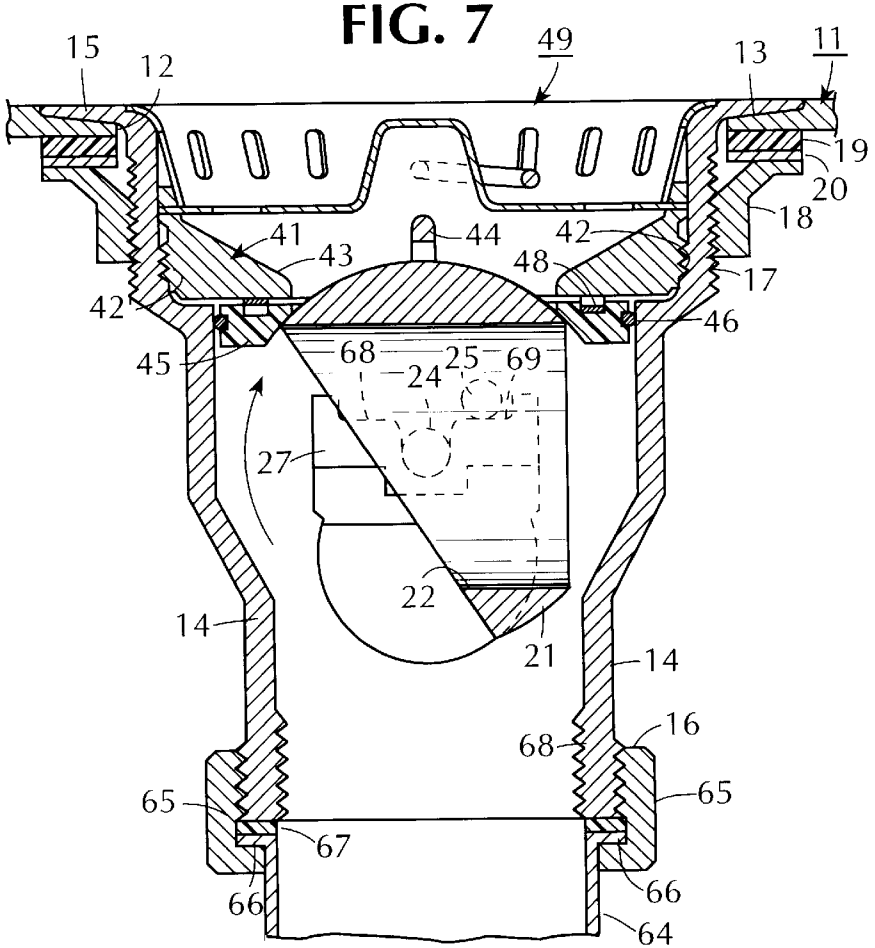
FIG. 7 illustrates a cross-sectional view of the drain assembly taken 90° from FIG. 5.

In order to close the drain assembly 10, the shaft 29 is simply turned via the grip 39, 40, 90° so as to move the ball valve 21 into the closed position shown in FIGS. 5 and 7. In this position, the ball valve 21 and seat 45 cooperate to completely block any flow of water from the sink 11 into the drain pipe 64.

Typically, the embodiment illustrated in FIGS. 1 to 7 has parts made of a non-corrosive metal such as stainless steel and other parts made of plastic. For example, the body 14, ball valve 21 and retainer 41 are made of stainless steel, the valve seat 45 is made of plastic and the O-ring 46 is made of a suitable material such as a Teflon coated rubber, or rubber, or the like.

Figure 6:
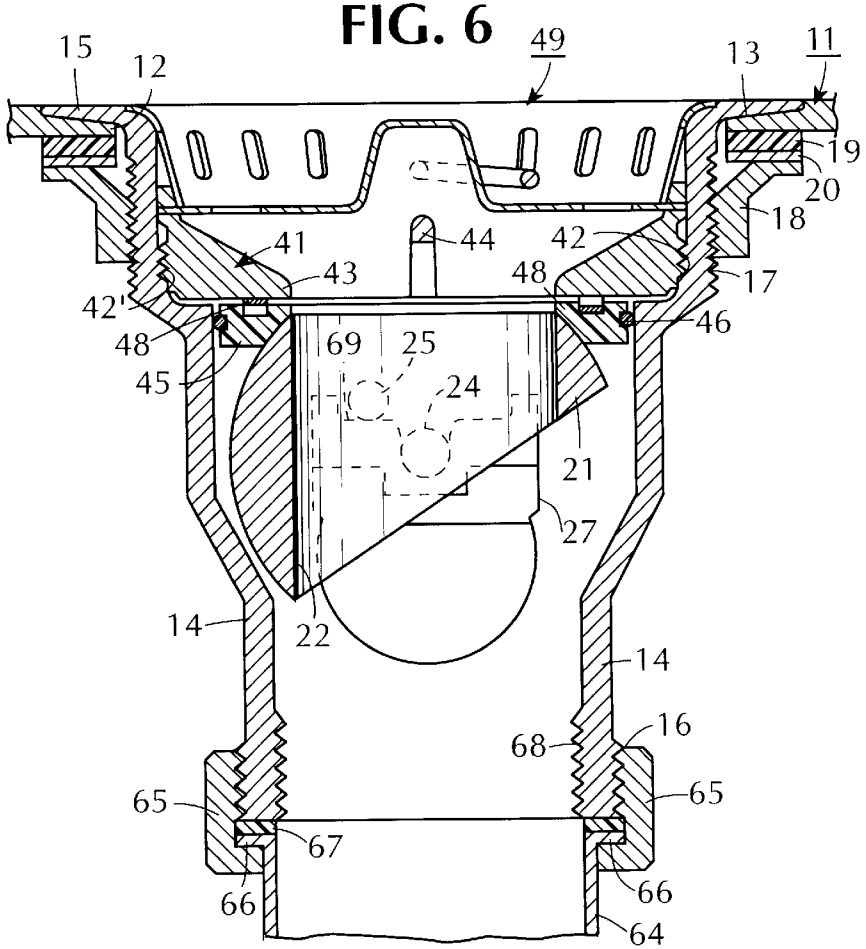
FIG. 6 illustrates a cross-sectional view of the drain assembly taken 90° from the view of FIG. 4.

Referring to FIGS. 6 and 7, the pin 25 on the valve 21 is offset from the roller 24 to act as a stop. Thus, when the ball valve 21 is in the open position (FIG. 6), the pin 25 abuts against a flat surface 69 of the trunion 27. When the ball valve 21 is rotated into the closed position (FIG. 7), the pin 25 abuts against a second flat surface 70 on the trunion 27.

Typically, each O-ring which is used in the drain assembly 10 is made of a suitable silicone base which is encapsulated in Teflon.

Figure 9:
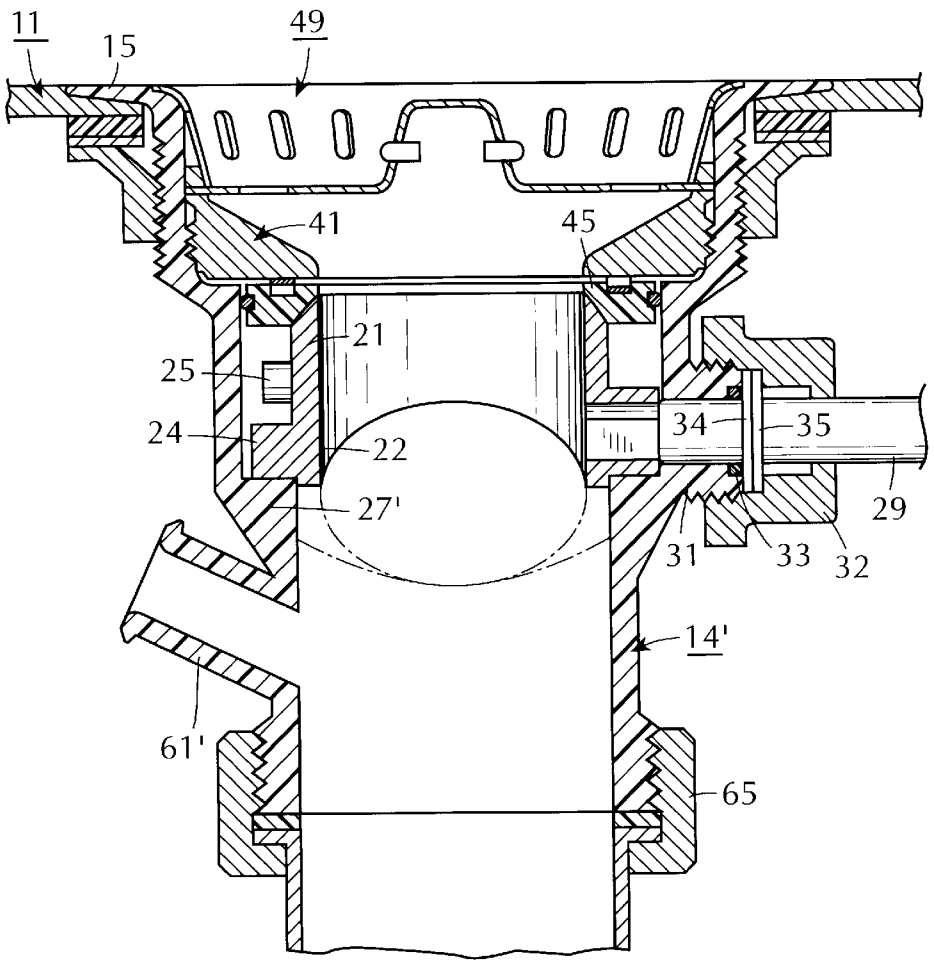
FIG. 9 illustrates a cross sectional view of the drain assembly of FIG. 8 with the ball valve in an open position.
Figure 8:
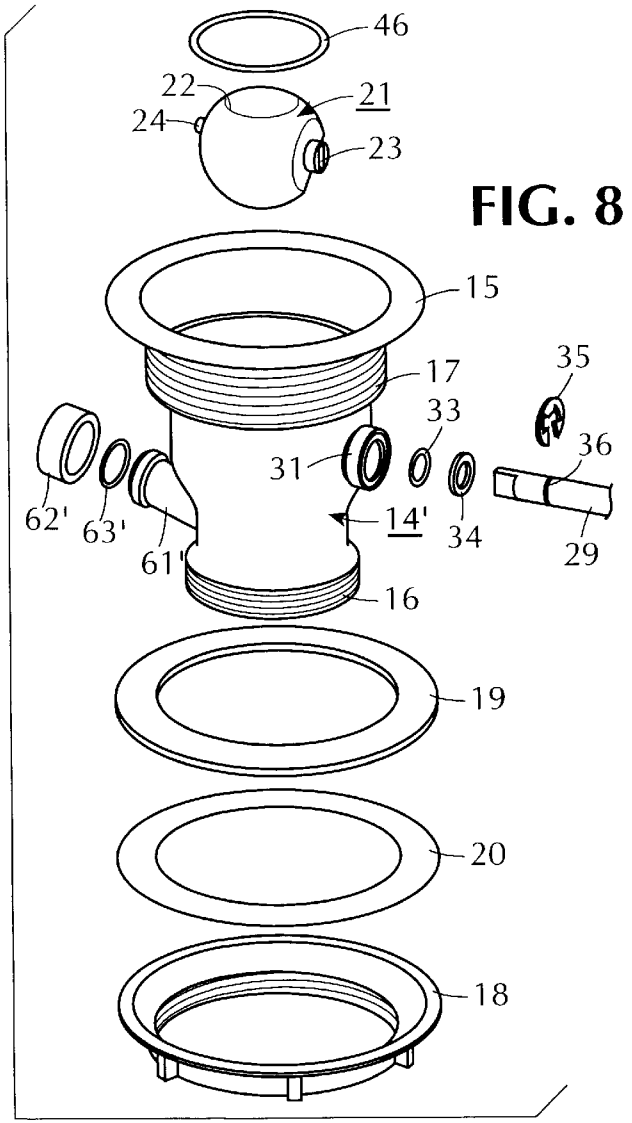
FIG. 8 illustrates an exploded view of a modified drain assembly in accordance with the invention.

Referring to FIGS. 8 and 9, wherein like reference characters indicate like parts as above, the drain assembly 10' may be made entirely of plastic parts. In this respect, the trunion 27 of FIG. 3 is eliminated and the body 14' is molded so that the function and purpose of the trunion is taken over by a similar portion 27' molded into the interior of the drain body 14'. In addition, the spigot 61' may have a tapered lip while the cap 62' which is also made of plastic is sealing mounted in place by being snap-fitted over the lip.

In the event that repairs are required in the drain assembly 10, such repairs may be made from the top of the sink 11. That is to say, access can be gained by simply removing the strainer 49, the retainer 41 and the valve seat 45. Typically, only the valve seat 45 or O-ring 46 would need replacement.

The invention thus provides a drain assembly which is relatively easy to mount in place by one person. Further, the invention provides a drain assembly which has a relatively long life. In this respect, the drain assembly may be made with stainless steel parts as well as with plastic parts such as Teflon coated O-ring seals and the like, which are impervious to chemicals.

The drain assembly allows various types of cleaning components, sanitizers and chemicals to be used without risk of damaging the drain assembly through corrosion or otherwise.

What is claimed is:

1. A drain assembly for a sink comprising a one-piece hollow body defining a fluid path, said body having an external thread for passage through an opening in the sink and an annular flange to seat about an opening in the sink;

a hollow ball valve rotatably mounted in said body in said flow path, said ball valve being rotatable between a closed position closing said fluid path and an open position opening said fluid path;

means for rotating said ball valve between said positions; and a flange nut threaded onto said external thread of said body to secure said body in the sink.

2. A drain assembly as set forth in claim 1 wherein said means includes an elongated shaft mounted in and extending laterally from said body, said shaft being coupled to said ball valve at one end to effect rotation of said ball valve between said positions thereof in response to rotation of said shaft.

3. A drain assembly as set forth in claim 1 further comprising a retainer secured to and within said body to retain said ball valve within said body.

4. A drain assembly as set forth in claim 3 which further comprises an annular valve seat between said ball valve and said retainer for sealingly seating against said ball valve, an O-ring sealingly disposed between said valve seat and said body and a compression device between said valve seat and said retainer for biasing said valve seat against said ball valve.

5. A drain assembly as set forth in claim 4 wherein said annular valve seat is made of polytetrafluroethylene.

6. A drain assembly as set forth in claim 4 wherein said compression device is an annular spring.

7. A drain assembly as set forth in claim 1 which further comprises a gasket concentric of said body and said external thread for seating against an underside of a sink opening and a slip ring between said gasket and said flange nut.

8. A drain assembly as set forth in claim 3 which further comprises a strainer disposed coaxially of and in said retainer.

9. A drain assembly as set forth in claim 8 wherein said strainer has a plurality of outwardly extending tabs and said retainer has a plurality of slot-defining projections for slidably receiving said tabs.

10. A drain assembly as set forth in claim 1 wherein said hollow ball valve is segmented and has a tubular bore passing therethrough, said bore being disposed axially of said body in said open position and being disposed transversely of said body in said closed position.

11. A drain assembly as set forth in claim 10 wherein said ball valve has a socket on one side and said means includes a shaft removably received in said socket in mating relation for rotation of said ball valve with said shaft.

12. A drain assembly as set forth in claim 11 wherein said body is made of plastic.

13. A drain assembly as set forth in claim 11 wherein said ball valve has a roller on an opposite side from said socket and which further comprises a trunion mounted in said body and rotatably receiving said roller therein.

14. A drain assembly as set forth in claim 13 wherein said body is made of stainless steel.

15. A drain assembly as set forth in claim 1 wherein said body has at least one overflow spigot communicating with said fluid path and a cap sealingly mounted on said spigot.

16. In combination a sink having an opening in a bottom thereof;

a one-piece body defining a fluid path in said opening and having a flange abutting said bottom of said sink from above;

a nut threaded onto said body from below said bottom of said sink to secure said body to said sink;

a hollow ball valve rotatably mounted in said body in said flow path, said ball valve being rotatable between a closed position closing said fluid path and an open position opening said fluid path; and means for rotating said ball valve between said positions.

17. The combination as set forth in claim 16 which further comprises a retainer threadably secured in said body to retain said ball valve therein, an annular valve seat between said ball valve and said retainer for sealingly seating against said ball valve, an O-ring sealingly disposed between said valve seat and said body and a compression device coaxially between said valve seat and said retainer for biasing said valve seat against said ball valve.

18. A drain assembly for a sink comprising a body defining a fluid path;

a hollow ball valve rotatably mounted in said body in said flow path, said ball valve being rotatable between a closed position closing said fluid path and an open position opening said fluid path;

means for rotating said ball valve between said positions;

a retainer secured to and within said body to retain said ball valve within said body;

an annular valve seat between said ball valve and said retainer for sealingly seating against said ball valve;

an O-ring sealingly disposed between said valve seat and said body; and a compression device between said valve seat and said retainer for biasing said valve seat against said ball valve.

19. A drain assembly as set forth in claim 18 wherein said annular valve seat is made of polytetrafluroethylene.

20. A drain assembly as set forth in claim 18 wherein said compression device is an annular spring.

21. A drain assembly for a sink comprising a body defining a fluid path;

a hollow ball valve rotatably mounted in said body in said flow path, said ball valve being rotatable between a closed position closing said fluid path and an open position opening said fluid path;

means for rotating said ball valve between said positions;

a retainer secured to and within said body to retain said ball valve within said body, said retainer having a plurality of slot defining projections; and a strainer disposed coaxially of and in said retainer, said strainer having a plurality of outwardly extending tabs slidably received in said slot-defining projections.

22. A drain assembly for a sink comprising a body defining a fluid path;

a hollow ball valve rotatably mounted in said body in said fluid path between a closed position closing said fluid path and an open position opening said fluid path, said hollow ball valve being segmented and having a tubular bore passing therethrough, said bore being disposed axially of said body in said open position and being disposed transversely of said body in said closed position, said ball valve having a socket on one side and a roller on an opposite side from said socket;

a trunion mounted in said body and rotatably receiving said roller therein; and means for rotating said ball valve between said positions, said means including a shaft removably received in said socket in mating relation for rotation of said ball valve with said shaft.

23. A drain assembly as set forth in claim 22 wherein said body is made of stainless steel.

* * * * *

UNITED STATES PATENT AND TRADEMARK OFFICE

CERTIFICATE OF CORRECTION

PATENT NO. : 6,058,526
DATED : May 9, 2000
INVENTOR(S) : Parisi, et al.

It is certified that error appears in the above-identified patent and that said Letters Patent is hereby corrected as shown below:

Title page,
[*] delete "628" and insert -- 133 --.

Signed and Sealed this

Sixteenth Day of October, 2001

*Attest:*

Nicholas P. Godici

NICHOLAS P. GODICI
*Acting Director of the United States Patent and Trademark Office*

*Attesting Officer*